US010758071B1

(12) United States Patent
Lin et al.

(10) Patent No.: US 10,758,071 B1
(45) Date of Patent: Sep. 1, 2020

(54) SMART FOLDING BOX

(71) Applicant: NANNING FUGUI PRECISION INDUSTRIAL CO., LTD., Nanning (CN)

(72) Inventors: Jyun-Fu Lin, New Taipei (TW); Jiunn-Her Li, New Taipei (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 0 days.

(21) Appl. No.: 16/395,521

(22) Filed: Apr. 26, 2019

(51) Int. Cl.
*A47G 29/14* (2006.01)

(52) U.S. Cl.
CPC ..... *A47G 29/141* (2013.01)

(58) Field of Classification Search
CPC ..... A46G 29/14; A46G 29/141; A46G 29/16; A46G 29/20; A46G 2029/144; A46G 2029/148; A46G 2029/149; B65D 21/086; B65D 7/26; B65D 7/30; B65D 7/32; E05B 65/0075; E05B 65/0085
USPC ..... 232/19, 38, 45; 220/6, 7; 340/569; 70/63
See application file for complete search history.

(56) References Cited

U.S. PATENT DOCUMENTS 2,456,479 A * 12/1948 Antil ..... A47G 29/14 220/6
6,426,699 B1 * 7/2002 Porter ..... A47F 10/00 221/2
10,321,780 B1 * 6/2019 James ..... A47G 29/16
10,537,196 B1 * 1/2020 MacPherson ..... A47G 29/16
2001/0040422 A1 * 11/2001 Gramlich ..... A47G 29/141 312/234
2016/0068306 A1 * 3/2016 Heinz ..... B65D 81/02 220/560.01
2016/0331171 A1 * 11/2016 Jiang ..... G06Q 10/0833
2017/0127868 A1 * 5/2017 Adewuyi ..... A47G 29/141
2017/0188737 A1 * 7/2017 Hippert ..... A47G 29/20
2018/0228310 A1 * 8/2018 Enobakhare ..... A47G 29/141
2018/0296016 A1 * 10/2018 Teoh ..... A47G 29/20
2019/0180544 A1 * 6/2019 Newcomb ..... G06Q 10/0836
2019/0225375 A1 * 7/2019 Sena ..... B65D 21/086
2019/0320836 A1 * 10/2019 Guanch ..... A47G 29/141
2019/0350398 A1 * 11/2019 Raphael ..... A47G 29/141
2020/0107663 A1 * 4/2020 Eivaz ..... A47G 29/141

* cited by examiner

*Primary Examiner* — William L Miller
(74) *Attorney, Agent, or Firm* — ScienBiziP, P.C.

(57) ABSTRACT

A smart folding box includes a support member, a number of folding members, a door, a locking mechanism, and a controller. The support member includes a support body and a connector. Each folding member is rotationally coupled to the support body and to the connector. The door is mounted on the connector and is configured to open or close an opening. The folding members are configured to fold or unfold to move the connector and the door. The locking mechanism includes an electric lock and a folding detection member. The electric lock and the folding detection member are electrically coupled to the controller and each mounted on one of the folding members. The support body defines a limiting slot. When the folding detection member detects that the folding members are in a folded state, the controller controls the electric lock to extend into the limiting slot.

13 Claims, 7 Drawing Sheets

SMART FOLDING BOX

FIELD

The subject matter herein generally relates to storage boxes, and more particularly to a smart folding box.

BACKGROUND

With the increasing demand for online shopping, items such as parcels are generally delivered to homes. The items generally cannot fit inside a mailbox, and so a courier usually delivers the items, and someone must sign for the items to receive the goods, which is inconvenient. Even if the size of a regular mailbox is modified to accommodate an item, the mailbox takes up a lot of space when there is no item inside.

BRIEF DESCRIPTION OF THE DRAWINGS

Implementations of the present disclosure will now be described, by way of embodiments, with reference to the attached figures.

DETAILED DESCRIPTION

Figure 1:
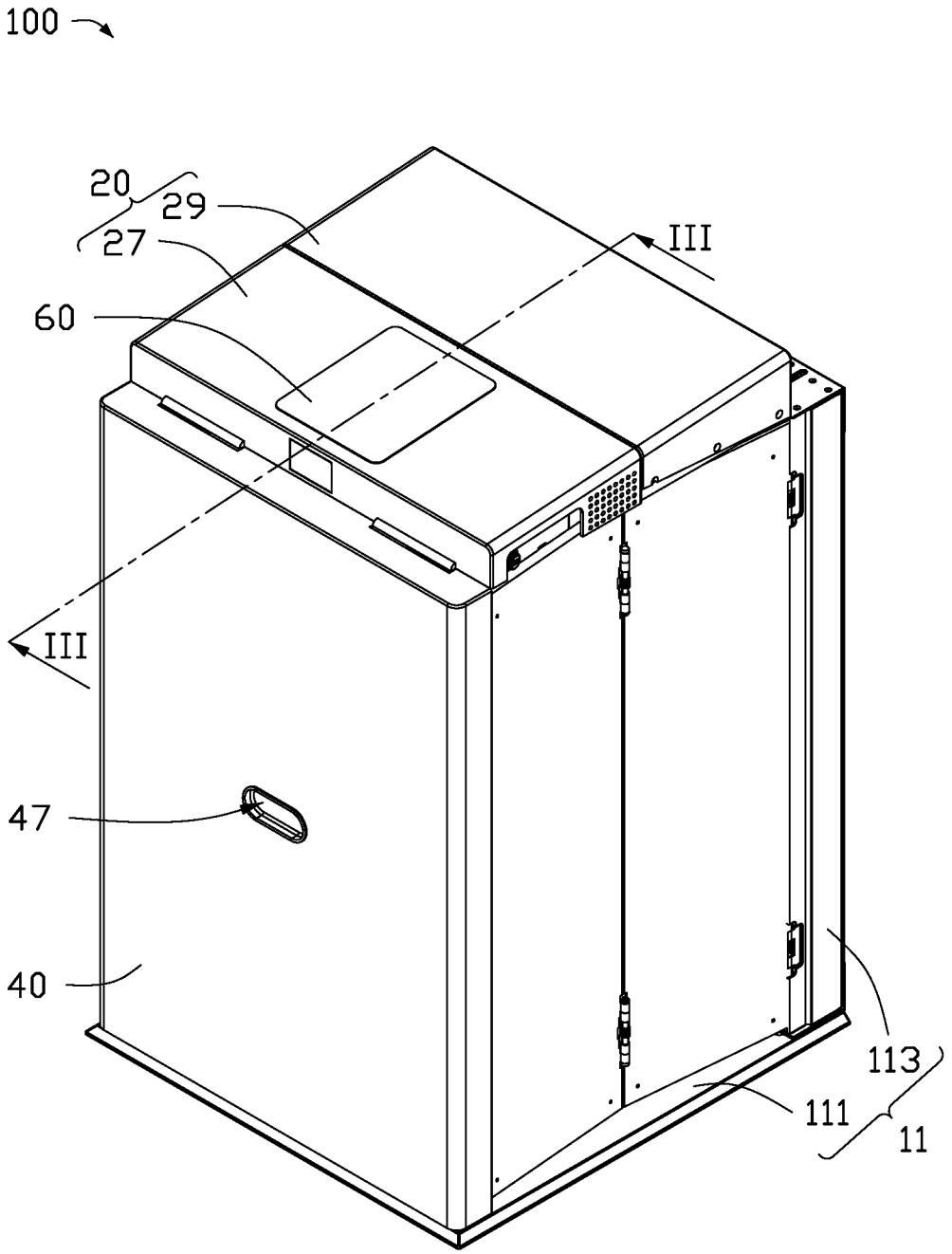
FIG. 1 is an assembled, isometric view of an embodiment of a smart folding box in an unfolded state.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

Figure 2:
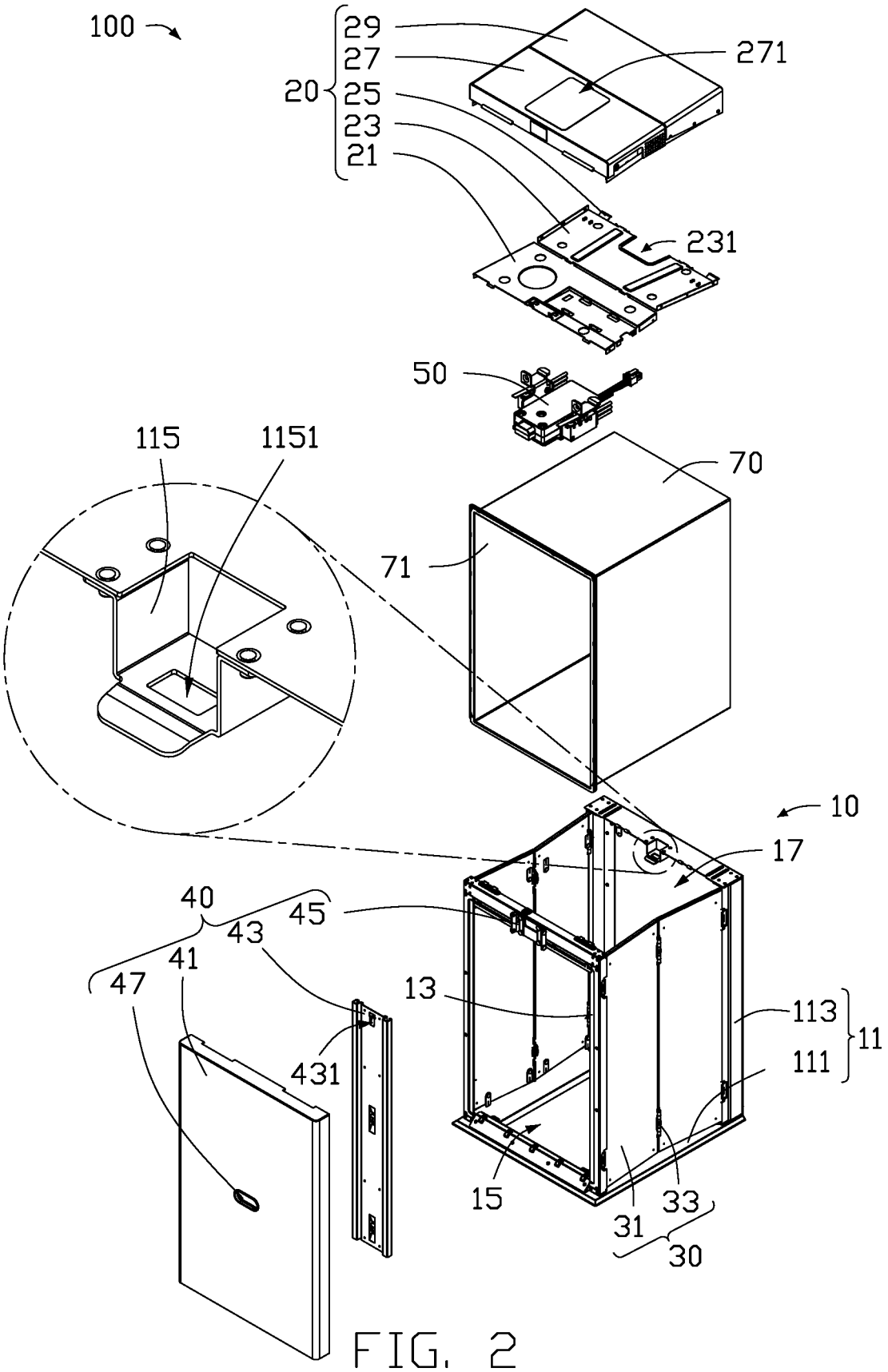
FIG. 2 is an exploded view of FIG. 1.

FIG. 1 and FIG. 2 show an embodiment of a smart folding box 100, which includes a support member 10, a plurality of folding members, a door 40, a locking mechanism 50, and a controller 60. In one embodiment, the plurality of folding members include a foldable cover 20 and two foldable sides 30. The support member 10 includes a support body 11 and a connector 13. The support body 11 includes a base 111 and a rear wall 113. The rear wall 113 is disposed on one side edge of the base 111. One side of each of the foldable sides 30 and one side of the foldable cover 20 is rotationally coupled to the rear wall 113, and another side of each of the foldable sides 30 and another side of the foldable cover 20 is rotationally coupled to the connector 13. In one embodiment, the connector 13 is substantially a U-shaped structure, but is not limited thereto. The two foldable sides 30 are respectively located on opposite side edges of the rear wall 113. The base 111, the rear wall 113, the connector 13, the foldable cover 20, and the two foldable sides 30 cooperatively define a receiving cavity 17 having an opening 15. The door 40 is mounted on the connector 13 and is configured to close or open the opening 15. The foldable sides 30 and the foldable cover 20 are configured to be folded or unfolded to move the connector 13 and the door 40 to change a volume of the receiving space 17. The locking mechanism 50 is disposed on a side of the foldable cover 20 facing the receiving space 17. The controller 60 is disposed on the foldable cover 20. The locking mechanism 50 is electrically coupled to the controller 60. When the foldable cover 20 is in a folded state, the controller 60 controls the locking mechanism 50 to be locked to the support body 11. When the foldable cover 20 is in an unfolded state, the controller 60 controls the locking mechanism 50 to be locked to the door 40.

Referring to FIG. 2, the foldable cover 20 includes a plurality of cover plates that are rotationally coupled in sequence. In one embodiment, a quantity of the cover plates is two and includes a first cover plate 21 and a second cover plate 23. One end of the first cover plate 21 is rotationally coupled to the second cover plate 23, and another end of the first cover plate 21 is rotationally coupled to an end of the connector 13 away from the base 111. One end of the second cover plate 23 away from the first cover plate 21 is rotationally coupled to the rear wall 113. The locking mechanism 50 is disposed on the first cover plate 21. The second cover plate 23 defines a clearance hole 231 to allow the locking mechanism 50 to pass through when the foldable cover 20 is in the folded state. In one embodiment, the clearance hole 231 is a hole defined in a peripheral edge of the second cover plate 23, but is not limited thereto. In other embodiments, the clearance hole 231 may be a slot.

Figure 3:
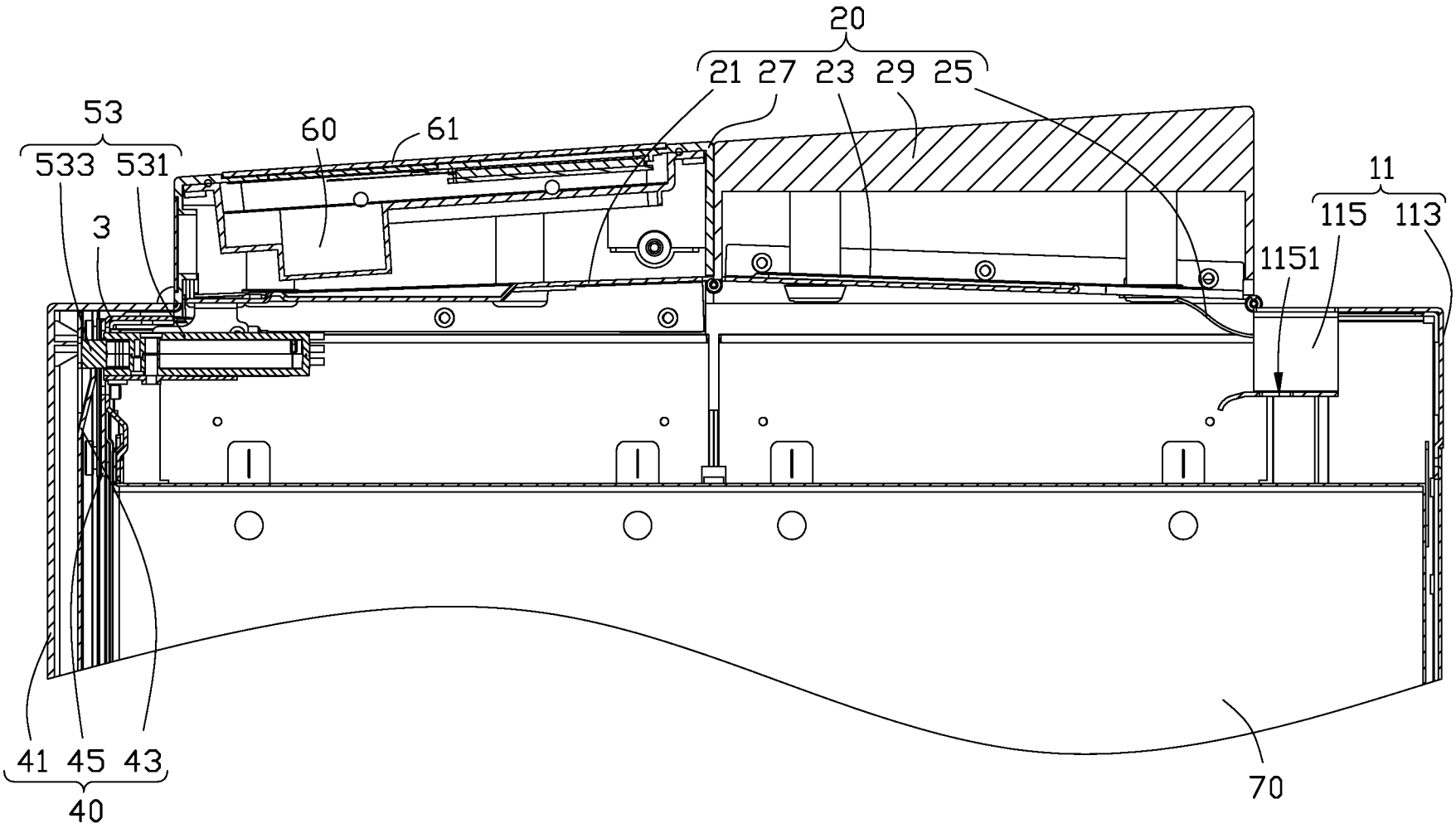
FIG. 3 is a cross-sectional view taken along line in FIG. 1.

Referring to FIG. 3, the foldable cover 20 further includes at least one elastic piece 25. The elastic piece 25 is located on the second cover plate 23. One end of each elastic piece 25 is coupled to the second cover plate 23, and another end of each elastic piece 25 abuts against the rear wall 113. The elastic piece 25 is configured to drive the second cover plate 23 to rotate away from the receiving space 17. That is, when the foldable cover 20 is in the folded state, a rotational joint of the first cover plate 21 and the second cover plate 23 is rotated away from the receiving space 17. In other embodiments, the elastic piece 25 can be omitted, and when the foldable cover 20 is in the folded state, the rotational joint of the first cover plate 21 and the second cover plate 23 can be rotated toward the receiving space 17.

Referring to FIG. 2 and FIG. 3, in one embodiment, the foldable cover 20 further includes a first protective cover 27 and a second protective cover 29. The first protective cover 27 is disposed on the first cover plate 21. The second protective cover 29 is disposed on the second cover plate 23.

The controller 60 is disposed on the first cover plate 21. The first protective cover 27 covers the controller 60. The controller 60 includes an interactive interface 61. The first protective cover 27 defines a receiving hole 271, and the interactive interface 61 is exposed through the receiving hole 271. The interactive interface 61 is used to input an operator's authorization information to send to the controller 60 a lock or unlock command of the locking mechanism 50 to open or close the door 40 and unfold or fold the smart folding box 100. The controller 60 can determine and verify the authorization information. When the verification is successful, the controller 60 controls the locking mechanism 50 to execute the lock or unlock command.

The first protective cover 27 and the second protective cover 29 enable the foldable cover 20 to be enclosed by the support member 10, the foldable sides 30, and the door 40 to close the receiving cavity 17, so that items contained in the smart folding box 100 can be protected. The protective cover 27 protects the controller 60. In other embodiments, the first protective cover 27 and the second protective cover 29 may be omitted, as long as the first cover plate 21 and the second cover plate 23 are closed by a plurality of covers to cover the receiving cavity 17 and the controller 60 is separately covered by a protective cover.

Referring to FIG. 1 and FIG. 2, each foldable side 30 includes a plurality of side panels 31 and a plurality of hinges 33. In one embodiment, a quantity of the side panels 31 of each foldable side 30 is two, but is not limited thereto. The two side panels 31 are coupled together by a plurality of hinges 33. Each hinge 33 has a high tensile force to bias the two side panels 31 to be relatively unfolded. In one embodiment, the two side panels 31 are folded into the receiving cavity 17. The two side panels 31 are respectively rotationally coupled to the rear wall 113 and the connector 13 at opposite sides of the foldable side 30. When the locking mechanism 50 is unlocked, the hinges 33 drive the two foldable sides 30 to automatically unfold the foldable cover 20. It will be understood that in other embodiments, the hinges 33 may be ordinary connecting hinges.

It can be understood that in other embodiments, the quantity of the side panels 31 of the foldable sides 30 may be three or more, and the quantity of the cover plates of the foldable cover 20 may be a plurality, as long as the quantity of side panels 31 and the plurality of cover plates can be folded or unfolded in sequence.

In other embodiments, the side panels 31 may be folded away from the receiving cavity 17.

Figure 4:
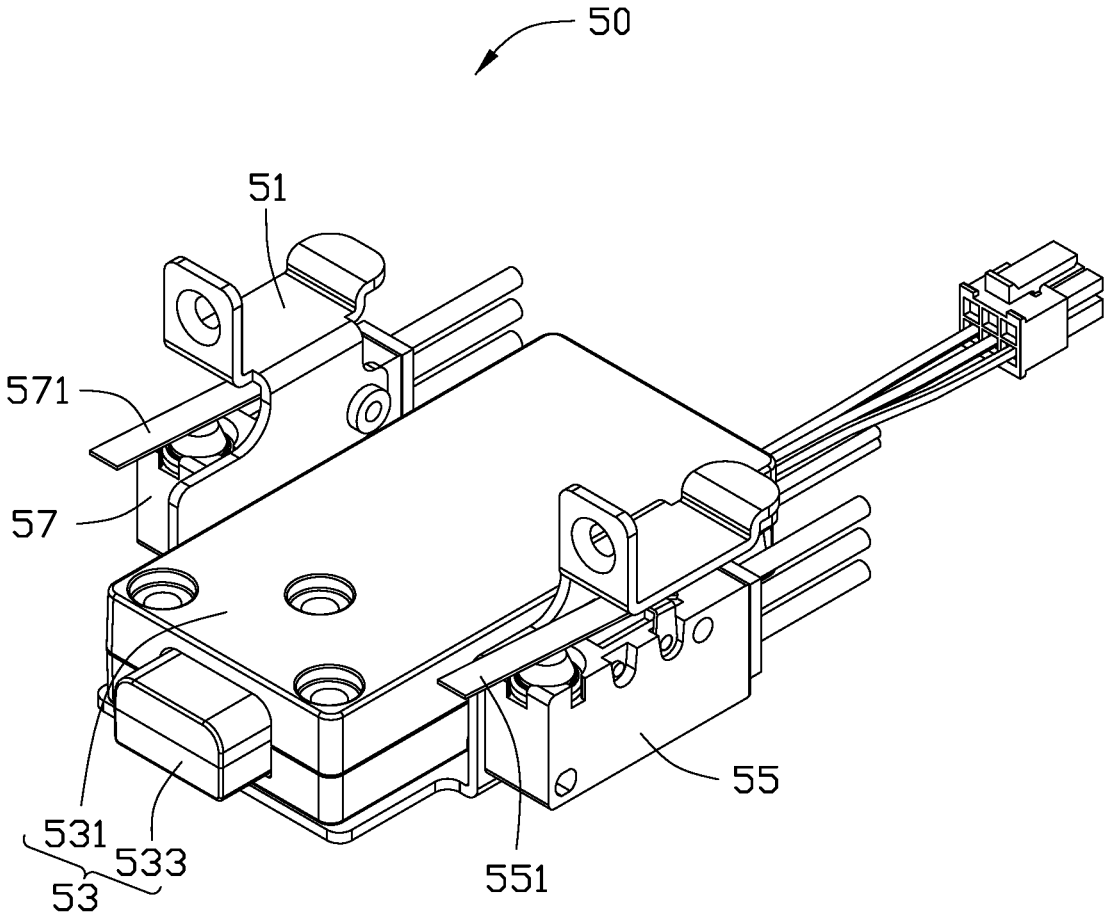
FIG. 4 is an isometric view of a locking mechanism shown in FIG. 1.

Referring to FIG. 4, the locking mechanism 50 includes a connecting frame 51, an electric lock 53, a folding detection member 55, and a door lock detection member 57. The electric lock 53, the folding detection member 55, and the door lock detection member 57 are electrically coupled to the controller 60. The connecting frame 51 is disposed on a side of the first cover plate 21 facing the receiving space 17. The electric lock 53 includes a lock body 531 and a lock core 533. The lock core 533 is disposed on the lock body 531, and the lock body 531 can drive the lock core 533 to extend and retract. The lock body 531, the folding detection member 55, and the door lock detection member 57 are disposed on the connecting frame 51. The folding detection member 55 is configured to detect a folded or unfolded state of the foldable cover 20. When the folding detection member 55 detects that the foldable cover 20 is in the folded state, the controller 60 controls the lock body 531 to drive the lock core 533 to extend to lock the foldable cover 20 with the support member 10. The door lock detection member 57 is configured to detect the open or closed state of the door 40. When the door lock detection member 57 detects that the door 40 is in the closed state, the controller 60 controls the lock body 531 to drive the lock core 533 to extend to lock the foldable cover 20 with the door 40.

Figure 5:
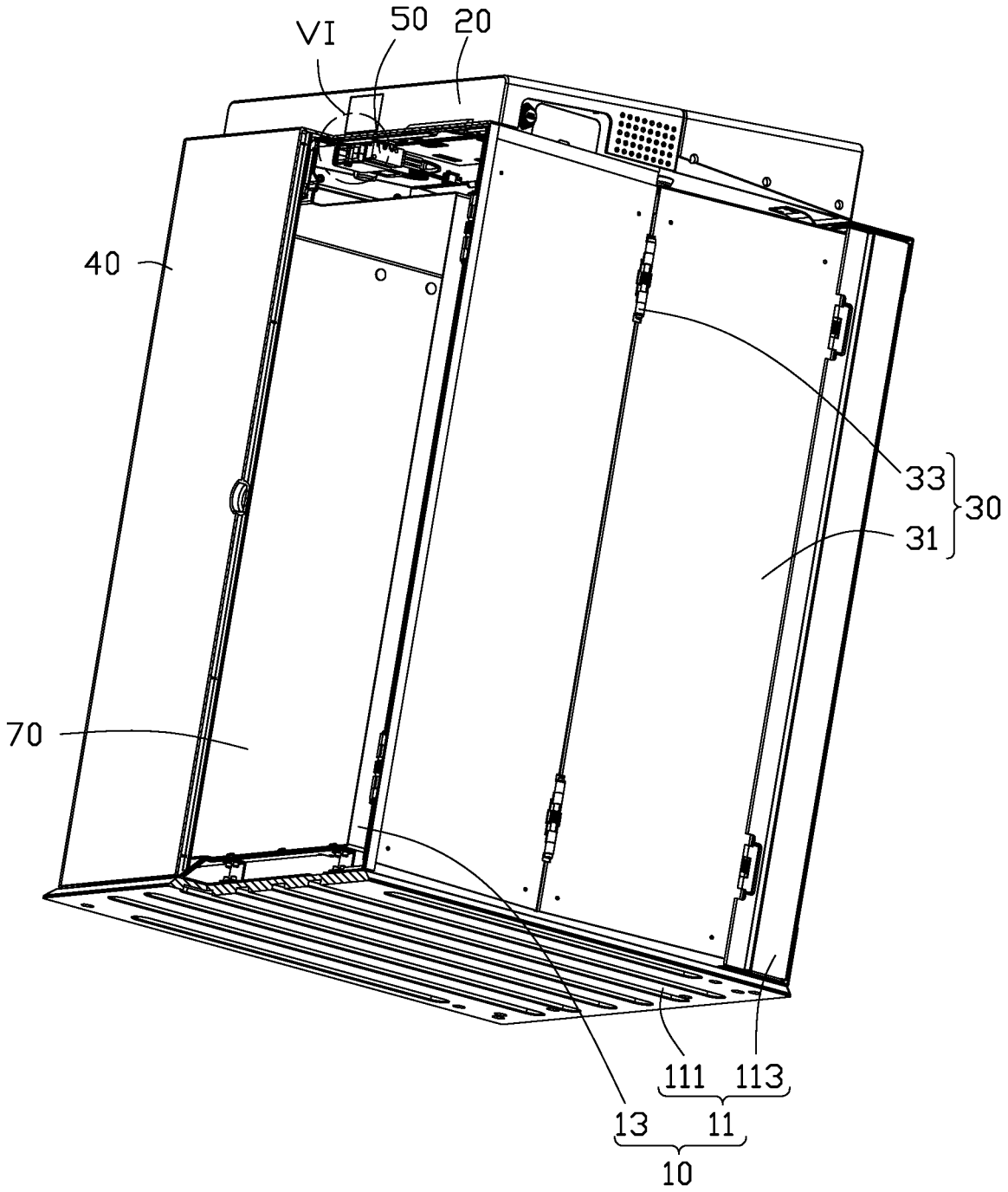
FIG. 5 is a partial cutaway view of the smart folding box in FIG. 1.
Figure 6:
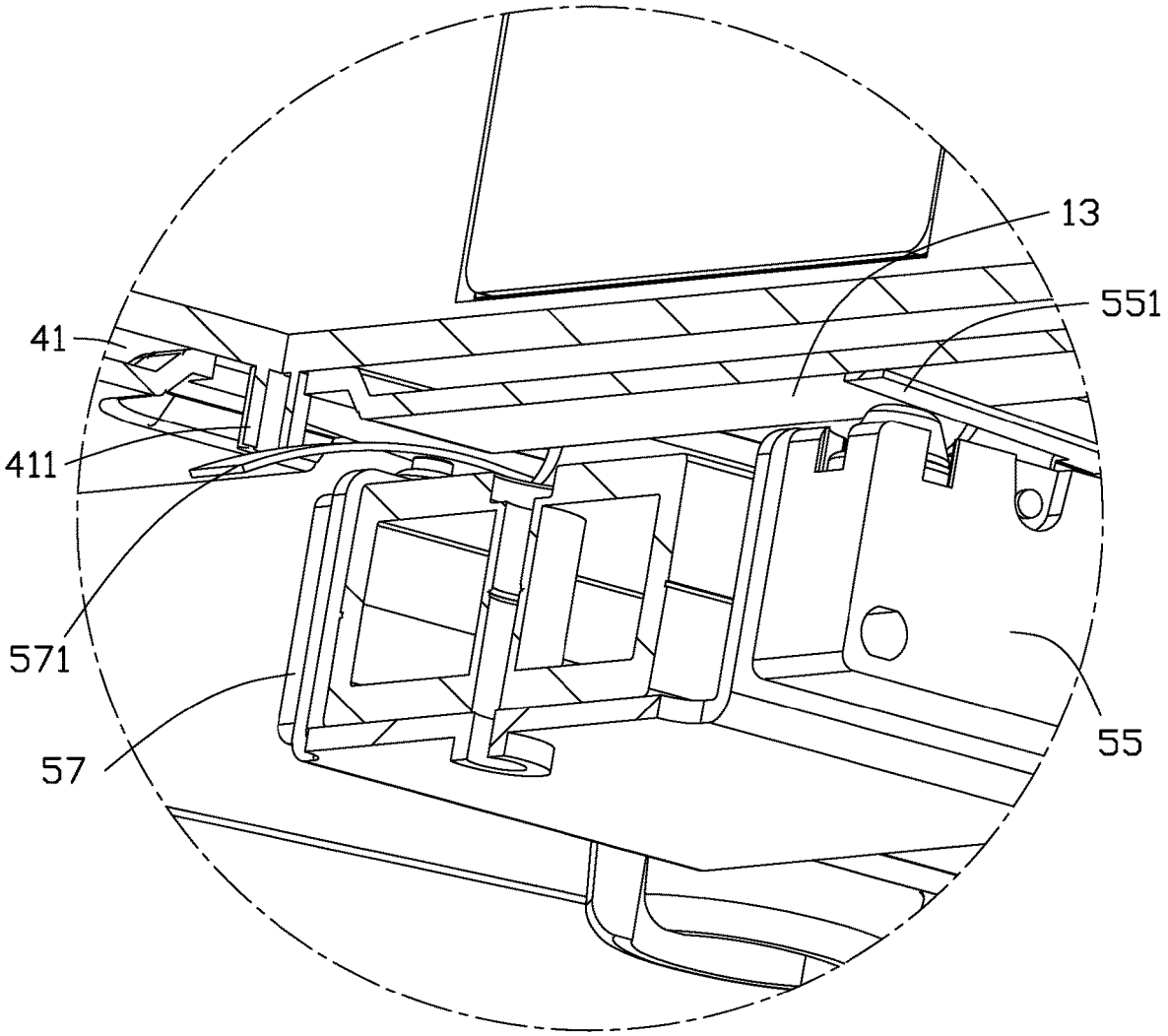
FIG. 6 is a close up view of a circled portion VI in FIG. 5.

Referring to FIG. 5 and FIG. 6, in one embodiment, the folding detection member 55 is a normally closed switch, but is not limited thereto. The support member 10 further includes a limiting member 115 (shown in FIG. 2). The limiting member 115 is disposed on a side of the rear wall 113 facing the receiving cavity 17. The limiting member 115 defines a limiting slot 1151 facing the foldable cover 20 in the unfolded state. The folding detection member 55 includes a first sensor 551. When the foldable cover 20 is in the unfolded state, the first sensor 551 of the folding detection member 55 is pressed by the connector 13, so the folding detection member 55 feeds back an unfolding signal to the controller 60, and the controller 60 controls the lock body 531 to drive the lock core 533 to retract. When the foldable cover 20 is folded, the folding detection member 55 is rotated relative to the connector 13 to gradually move the first sensor 551 away from the connector 13 until the foldable cover 20 is folded, and the first sensor 551 is separated from the connector 13, so the folding detection member 55 feeds back a folding signal to the controller 60, and the controller 60 controls the lock body 531 to drive the lock core 533 to extend to be inserted into the limiting slot 1151. Thus, the smart folding box 100 is locked in a folded state and does not occupy much space.

It can be understood that in other embodiments, the electric lock 53 can also be disposed on the second cover plate 23, the first cover plate 21 defines another clearance hole 231, and the limiting member 115 correspondingly defines another limiting slot 1151, so that when the first cover plate 21 and the second cover plate 23 are folded, the other clearance hole 231 can avoid the electric lock 53, and the lock core 533 of the electric lock 53 is inserted into the other limiting slot 1151.

It can be understood that in other embodiments, the electric lock 53 can also be disposed on one of the side panels 31 of one of the foldable sides 30, the remaining side panels 31 correspondingly define another clearance hole 231, and the limiting member 115 correspondingly defines another limiting slot 1151. Thus, when the first cover plate 21 and the second cover plate 23 are folded, the other clearance hole 231 can avoid the electric lock 53, and the lock core 533 is inserted into the other limit slot 1151.

Referring to FIG. 2 and FIG. 3, the door 40 includes a door panel 41, a sliding rail 43, and a guiding member 45. The sliding rail 43 is disposed on a side of the door panel 41 facing the connector 13. One side of the guiding member 45 is mounted on the connector 13, and the other side is slidably mounted on the sliding rail 43, so that the door panel 41 can slide relative to the connector 13 to open or close the opening 15. The door lock detection member 57 is configured to detect an open or closed state of the door 40 when the foldable cover 20 is in the unfolded state. When the door lock detection member 57 detects that the door 40 is in the closed state, the controller 60 controls the lock body 531 to drive the lock core 533 to extend to lock the door 40 to the support member 10.

In one embodiment, the lock body 531 and the door lock detection member 57 are located on the first cover plate 21 adjacent to the door 40. The door lock detection member 57 is a normally open switch, and the door lock detection member 57 includes a second sensor 571. The door panel 41 includes a resisting portion 411 (shown in FIG. 5). The connector 13 defines a through hole (not labeled). The sliding rail 43 defines an inserting slot 431 facing the electric lock 53. In other embodiments, the slot 431 can be defined in the door panel 41. When the door 40 is in the closed state, the resisting portion 411 is pressed against the second sensor 571 through the through hole, and the door lock detection member 57 feeds back a locking signal to the controller 60, so that the controller 60 controls the lock body 531 to drive the lock core 533 to extend and sequentially passes through the connector 13 and the guiding member 45 to be inserted into the inserting slot 431. Thus, the door 40 is locked to the support member 10 to prevent the door 40 from being arbitrarily opened to safeguard items in the smart folding box 100. When the door 40 is in the open state, the door panel 41 drives the resisting portion 411 to separate from the second sensor 571, the door lock detection member 57 feeds back an unlocking signal to the controller 60, and the controller 60 controls the lock body 531 to drive the lock core 533 to retract.

Figure 7:
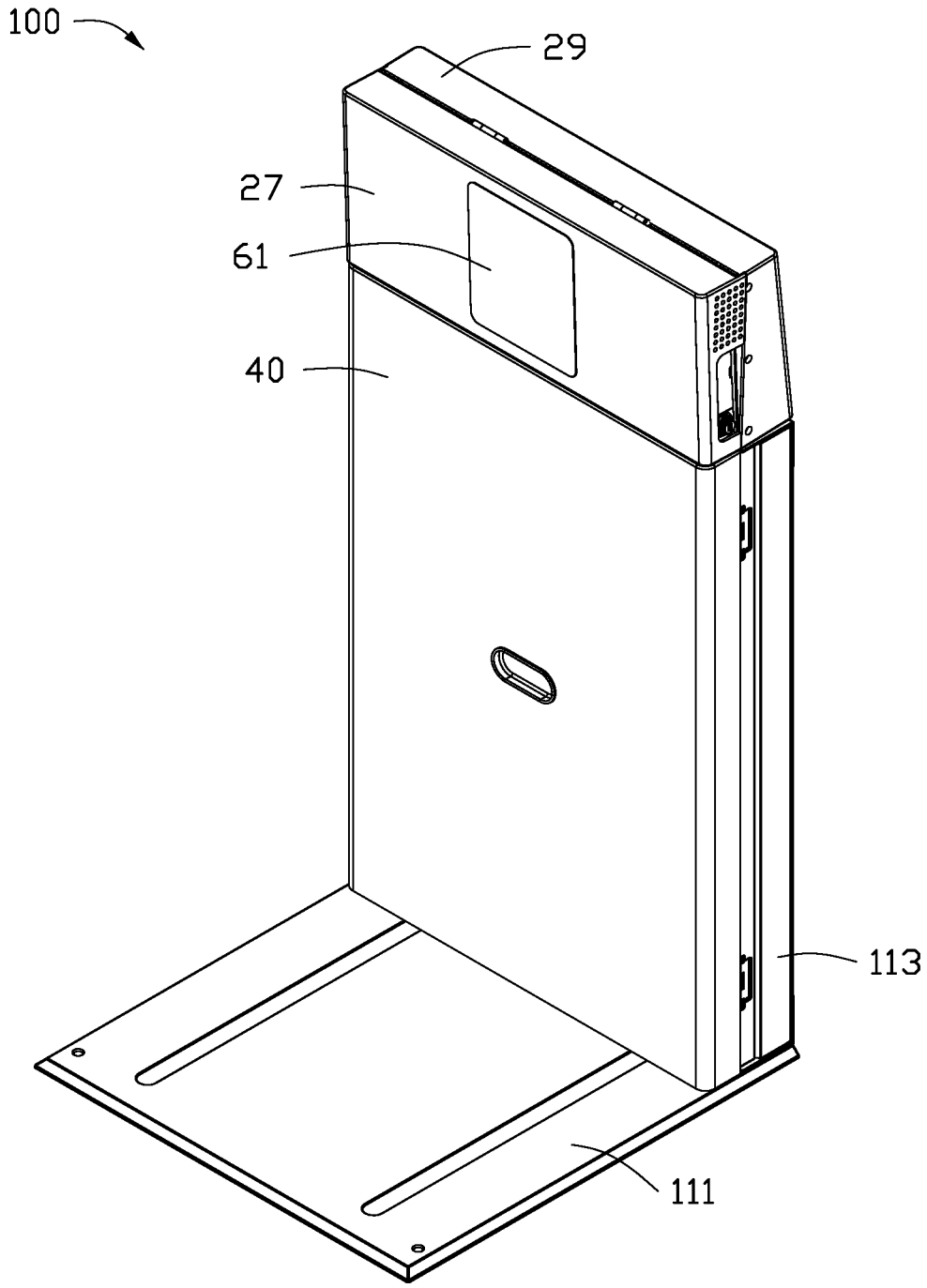
FIG. 7 shows the smart folding box in FIG. 1 in a folded state.

Referring to FIG. 7, when the smart folding box 100 is in the folded state, the first cover plate 21 and the second cover plate 23 of the foldable cover 20 are folded away from the receiving cavity 17, so that the first protective cover 27 is rotated to abut against a side of the door 40 away from the base 111. When the smart folding box 100 does not have items inside, the door 40 is in the closed state.

It can be understood that in other embodiments, the folding detection member 55 and the door lock detection member 57 may be photoelectric sensors.

It can be understood that in other embodiments, the door lock detection member 57 can be omitted. One side of the door 40 can also be rotationally coupled to the connector 13, and another side of the door 40 can be attached to the connector 13 by a mechanical lock to enable the door 40 to open or close the opening 15.

It can be understood that in other embodiments, the electric lock 53 can be disposed on a different folding member as the folding detection member 55 and the door lock detection member 57. For example, the electric lock 53 is disposed on the side panel 31 of one foldable side 30 adjacent to the connector 13, and the folding detection member 55 and the door lock detection member 57 are disposed on the first cover plate 21, as long as the support body 11 correspondingly defines another limiting slot and the door 40 defines another inserting slot for the electric lock 53 to be inserted.

Referring to FIG. 1, in one embodiment, the door 40 further includes a handle 47 for facilitating opening and closing of the door 40. The handle 47 is integrally formed in the door panel 41 with an internal buckle structure to save space, but is not limited thereto. It can be understood that in other embodiments, the handle 47 can also be omitted or adopt other structures.

Referring to FIG. 2 and FIG. 3, the smart folding box 100 further includes a lining bag 70. The lining bag 70 is coupled to the rear wall 113, the connector 13, and the foldable side 30, and is located in the receiving space 17. When the smart folding box 100 is folded, the lining bag 70 is gradually folded with the foldable sides 30. The lining bag 70 defines a bag opening 71 facing the door 40, and the bag opening 71 communicates with the opening 15 to allow an item to be received inside the lining bag 70 through the opening 15 and the bag opening 71. The lining bag 70 can be made of waterproof, fireproof, or oil proof material to protect the items therein. It can be understood that in other embodiments, the lining bag 70 can also be omitted. It can be understood that in other embodiments, the lining bag 70 can also be disposed outside the receiving cavity 17.

It can be understood that in other embodiments, the base 111 can also be a foldable structure.

When there is no item to be stored, the smart folding box 100 is in a folded state, the electric lock 53 is in a locked state, and the lock core 533 is inserted into the limiting slot 1151 of the limiting member 115. When an item needs to be stored, an operator can input authorization information through the interaction interface 61 to send an unlocking instruction of the locking mechanism 50 to the controller 60. The controller 60 controls the lock body 531 to drive the lock core 533 to retract. The hinges 33 drive the foldable sides 30 and the foldable cover 20 to unfold. The first sensor 551 of the folding detection member 55 is abutted by the connector 13, and the folding detection member 55 feeds back the unfolding signal to the controller 60. Then the door panel 41 is opened to place an item inside to be stored. The door panel 41 is closed, and the resisting portion 411 is passed through the through hole to resist against the second sensor 571 of the door lock detection member 57. The door lock detection member 57 feeds back the locking signal to the controller 60. The controller 60 controls the lock body 531 to drive the lock core 533 to extend and sequentially pass through the connector 13 and the guiding member 45 to be inserted into the inserting slot 431. When the item needs to be taken out, the operator can input the authorization information through the interactive interface 61 to send the unlocking instruction of the locking mechanism 50 to the controller 60. When the controller 60 verifies the authorization information, the controller 60 controls the control lock 531 to drive the lock core 533 to retract.

The smart folding box 100 is in a folded state when no items are stored, thereby reducing an occupied space of the smart folding box 100. The electric lock 53 can lock the folding members on the support member 10, thereby preventing the folding members of the smart folding box 100 from slipping due to gravity or other external force. When it is necessary to store an item, the controller 60 controls the electric lock 53 to unlock to unfold the smart folding box 100, and the door 40 is opened to place the item. Thus, the smart folding box 100 makes it easier and safer to store and collect items.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A smart folding box comprising:

a support member;

a plurality of folding members;

a door;

a locking mechanism; and a controller; wherein:

the support member comprises a support body and a connector;

each folding member is rotationally coupled to the support body and to the connector;

the support member and the plurality of folding members surround and cooperatively define a receiving space having an opening;

the door is mounted on the connector and is configured to open or close the opening;

the plurality of folding members are configured to fold or unfold to move the connector and the door;

the locking mechanism comprises an electric lock and a folding detection member;

the electric lock and the folding detection member are electrically coupled to the controller and each mounted on one of the folding members;

the support body defines a limiting slot;

the folding detection member is configured to detect whether the plurality of folding members are in a folded state or an unfolded state and feed back a corresponding signal to the controller;

when the folding detection member detects that the plurality of folding members are in the folded state, the controller controls the electric lock to extend into the limiting slot.

2. The smart folding box of claim 1, wherein:

the folding detection member is mounted on one of the folding members adjacent to the connector;

the folding detection member is a normally closed switch;

the folding detection member comprises a first sensor;

when the plurality of folding members are in the unfolded state, the first sensor is pressed by the connector;

when the plurality of folding members are folded, the folding detection member is rotated relative to the connector to cause the first sensor to gradually move away from the connector until the plurality of folding members are in the folded state;

when the first sensor is separated from the connector, the folding detection member feeds back a locking signal to the controller.

3. The smart folding box of claim 1, wherein:

the door comprises a door panel, a sliding rail, and a guiding member;

the sliding rail is mounted on a side of the door panel facing the connector;

one side of the guiding member is mounted on the connector, and another side of the guiding member is slidably mounted to the sliding rail.

4. The smart folding box of claim 3, wherein:

the locking mechanism further comprises a door lock detection member mounted on one of the folding members adjacent to the connector;

the door lock detection member is configured to detect whether the door is in an open state or a closed state when the plurality of folding members are in the unfolded state;

the door defines an inserting slot facing the electric lock;

when the door lock detection member detects that the door is in the closed state, the controller controls the electric lock to insert into the inserting slot.

5. The smart folding box of claim 4, wherein:

the door lock detection member is a normally open switch and comprises a second sensor;

the door comprises a resisting portion;

the connector defines a through hole;

when the door is in the closed state, the resisting portion passes through the through hole to press the second sensor, and the door lock detection member feeds back a locking signal to the controller.

6. The smart folding box of claim 1 further comprising a lining bag, wherein:

the lining bag is coupled to the support body and the plurality of folding members;

the lining back defines a bag opening facing the door and communicating with the opening.

7. The smart folding box of claim 1, wherein:

the plurality of folding members comprise two foldable sides and a foldable cover;

one side of each of the two foldable sides and one side of the foldable cover is rotationally coupled to the support body, and another side of each of the two foldable sides and another side of the foldable cover is rotationally coupled to the connector;

the two foldable sides are located on opposite sides of the foldable cover.

8. The smart folding box of claim 7, wherein:

each foldable side comprises a plurality of side panels and a plurality of hinges;

the plurality of side panels are rotationally coupled between the support body and the connector;

each two adjacent side panels are coupled together by at least one hinge;

each hinge has a high tensile force to bias the side panels to be relatively unfolded.

9. The smart folding box of claim 7, wherein:

the foldable cover comprises a plurality of cover plates rotationally coupled in sequence;

the plurality of cover plates are rotationally coupled between the connector and the support body;

the electric lock is mounted on one of the cover plates adjacent to the connector;

the remaining cover plates define a clearance hole to allow the electric lock to pass through when the folding cover is folded.

10. The smart folding box of claim 9, wherein:

the foldable cover comprises a first cover plate, a second cover plate, and at least one elastic piece;

the connector, the first cover plate, the second cover plate, and the support body are rotationally coupled in sequence;

one end of the elastic piece is coupled to the second cover plate, and another end of the elastic piece abuts against the support body;

the elastic piece is configured to drive the second cover plate to rotate away from the receiving space.

11. The smart folding box of claim 10, wherein:

the foldable cover further comprises a first protective cover and a second protective cover;

the first protective cover is covered over the first cover plate;

the second protective cover is covered over the second cover plate;

when the first cover plate and the second cover plate are folded, the first protective cover abuts against the door.

12. The smart folding box of claim 1, wherein:

the controller comprises an interactive interface configured to input authorization information to send to the controller a lock or unlock command of the locking mechanism to open or close the door and unfold or fold the smart folding box;

the controller verifies the authorization information.

13. A smart folding box configured to change a volume therein, the smart folding box comprising:

a support member comprising a support body, a connector, and two foldable sides;

a door;

a foldable cover;

a locking mechanism; and a controller; wherein:

the two foldable sides are located on opposite sides of the support member;

each foldable side is rotationally coupled between the support body and the connector;

the foldable cover is rotationally coupled between the support body and the connector;

the support body, the two foldable sides, the foldable cover, and the door cooperatively surround and define a receiving space having an opening;

the door is mounted on the connector and is configured to open or close the opening;

the foldable sides and the foldable cover are configured to fold or unfold to move the connector and the door;

the locking mechanism comprises an electric lock and a folding detection member;

the electric lock and the folding detection member are electrically coupled to the controller and each mounted on one of the foldable sides or the foldable cover;

the support body defines a limiting slot;

the folding detection member is configured to detect whether the foldable sides and the foldable cover are in a folded state or an unfolded state and feed back a corresponding signal to the controller;

when the folding detection member detects that the foldable sides and the foldable cover are in the folded state, the controller controls the electric lock to extend into the limiting slot.

* * * * *